United States Patent [19]

Bogert

[11] 3,938,715

[45] Feb. 17, 1976

[54] PROTECTIVE CLOSURES FOR CONTAINERS

[76] Inventor: Clayton Bogert, 118 Lowell Road, Glen Rock, N.J. 07452

[22] Filed: Nov. 20, 1972

[21] Appl. No.: 307,880

[52] U.S. Cl. ..... 222/534; 215/213; 215/216; 215/221

[51] Int. Cl.[2] ..... B65D 55/14

[58] Field of Search ..... 222/507, 556, 535; 215/9

[56] References Cited

UNITED STATES PATENTS

| | | | |
|---|---|---|---|
| 3,295,707 | 1/1967 | Knies | 222/556 X |
| 3,782,577 | 1/1974 | Levey | 222/534 X |
| 3,795,337 | 3/1974 | Nozawa et al. | 215/9 |

*Primary Examiner*—Stanley H. Tollberg

[57] ABSTRACT

There is provided a safety closure container in which the neck portion of the container has slots and a notch. A cap having lugs is secured to the neck portion, with the lugs being accommodated by its slots. The cap is also provided with a latch at its forward end and a hinge. In addition, the cap has a depending cam portion on the underside thereof. A sleeve surrounds the cap and the neck of the container. The sleeve has an internally extended rod which extends into the notch portion of the neck of the container and interlocks with the latch on the cap to prevent inadvertent opening thereof. A bar provided interiorly of the sleeve also extends into the notch in the neck of the container limiting the movement of the sleeve. The neck of the container also has an inwardly extending shoulder upon which the cap rests. A gasket is normally disposed on the shoulder and underneath the cap. To open the cap it is only necessary to depress the cap to cause the latch to fall away from the rod and turn the sleeve carrying the rod to assume a position away from the latch. The cap will thereupon lift upon the hinge exposing the contents for pouring. To relock the assembly it is only necessary to depress the cap and the bar automatically rides over the inclined plane of the cam on the cap unitl the rod assumes its position above the latch so that when the depressing force is released the latch will reengage the rod and lock the cap in position.

6 Claims, 9 Drawing Figures

PROTECTIVE CLOSURES FOR CONTAINERS

The present invention relates to safety closures for containers which resist the exposure of the contents of the containers to children and inadvertent opening of the containers.

BACKGROUND OF THE INVENTION

Containers for household chemicals, medicines, and other products potentially dangerous to children have heretofore been provided with conventional closures which are easy to open and the contents have therefore been readily accessible. As a consequence a dangerous situation existed as a result of the easy exposure of certain products to children and others who may not be aware of the nature of the contents in the container.

Attempts have heretofore been made to solve this problem which for the most part involve cap covers requiring downward external pressure on the cover before the container can be opened. However, such closures are not completely satisfactory because of the ease with which they can be inadvertently opened and their lack of a positive locking means. In addition, such closures do not automatically lock when the closure is replaced on the container after removal of the contents nor do they provide means for visually ascertaining whether the closure has locked.

OBJECTS AND FEATURES OF THE PRESENT INVENTION

An object of the present invention is to provide a closure which can be positively locked to resist access to the contents of the container by children.

Another object of the invention is to provide a closure which, while resistant to inadvertent opening, will in no way affect the contents of the container.

Still another object of the present invention is to provide a resistant to opening closure. It is relatively uncomplicated yet very effective and quite economic to produce.

Still another object of the present invention is to provide a closure which may be utilized on containers of conventional sizes and shapes without necessarily altering the construction of the container itself.

A feature of the present invention is the provision of a resistant to opening closure which automatically locks after it is returnend to its place on the container.

Another feature of the present invention is the provision of a resistant to opening closure which will show whether the closure is locked in its appropriate place upon visual inspection.

Another feature of the present invention is the provision of a resistant to opening closure which may be provided with a spout for the dispensing of the contents of the container.

Other objects and advantages are set forth in the disclosure of the following specification and drawings in which.

Figure 1:
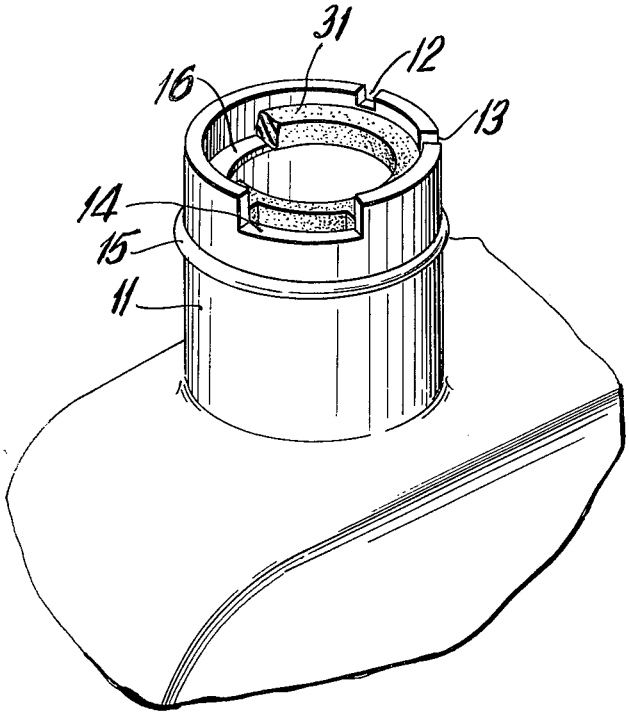
FIG. 1 is a perspective view of the inner ring of the closure of the present invention which may be the neck portion of the container itself.
Figure 2:
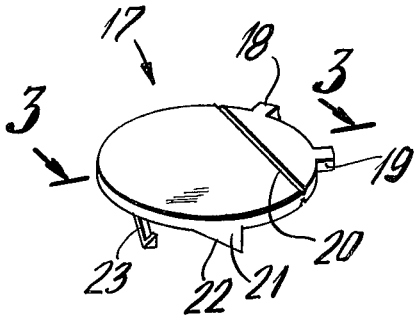
FIG. 2 is a perspective view of the cap of the closure of the present invention.
Figure 3:
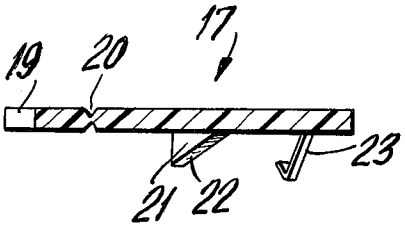
FIG. 3 is a sectional view of the cap shown in FIG. 2 taken along the lines 3—3 of FIG. 2.
Figure 4:
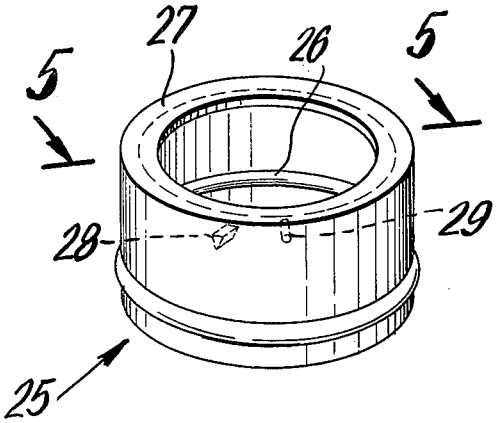
FIG. 4 is a perspective view of the sleeve which fits around the outer ring shown in FIG. 1.
Figure 5:
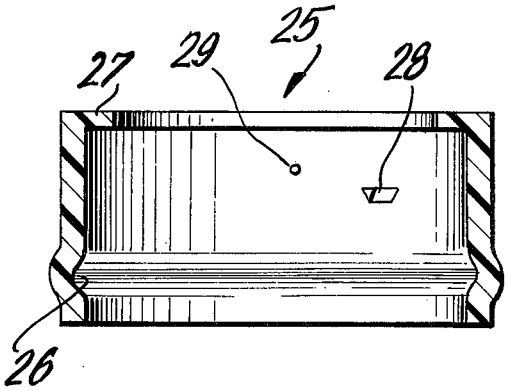
FIG. 5 is a sectional view of the sleeve taken along the lines 5—5 of FIG. 4.
Figure 6:
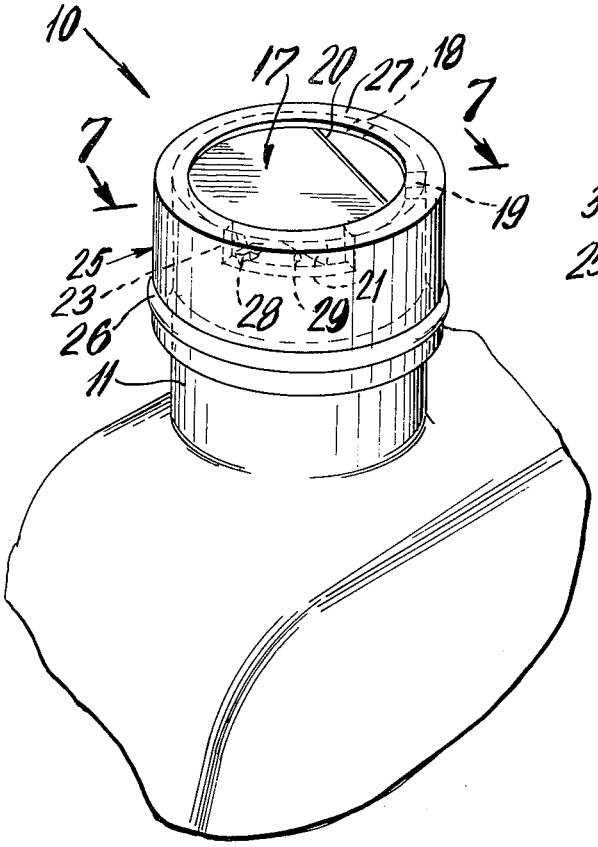
FIG. 6 is a perspective view of the closure of the present invention with the various parts in their appropriate resistant to opening position.
Figure 7:
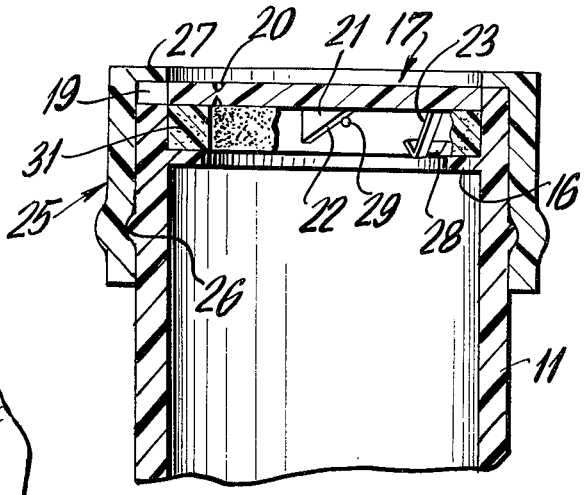
FIG. 7 is a sectional view of the closure taken along the lines 7—7 of FIG. 6.

The protective closure 10 of the present invention has an inner ring 11. As shown in FIG. 1 this inner ring may actually be the neck of the container. However, it will be understood that the inner ring may be an independent structure which is adapted to be attached to the neck of any conventional container which is currently available by any suitable means as for example an internal thread on the ring and so forth. The inner ring is provided with slots 12 and 13 and with a relatively elongate notch 14. A beaded portion 15 around the outer circumference and a ledge 16 around the inner circumference are also provided for the purposes hereinafter set forth.

A cap 17 is accomodated over the inner ring and has lugs 18 and 19 which are adapted to fit into a terminal held by the slots 12 and 13 respectively. The cap has a hinge 20 so that the cap can lift around the hinge to expose the contents of the container. It is to be understood that the position of this hinge as shown in the drawings is merely for illustrative purposes and that the hinge may be located in various positions on the cap depending upon the size of the aperture desired.

A locking cam 21 having an inclined plane 22 is disposed on the under side of the cap. In addition a catch 23 is also provided at one edge of the bottom of the cap for the purposes hereinafter described. While only one catch has been illustrated it will be understood that several may be disposed aroung the outer perimeter of the under side of the cap.

A sleeve 25 is adapted to be placed over the exterior of the inner ring 11. The sleeve has an internally recessed groove 26 which holds the sleeve in position by its snap-fit engagement with the bead 15. The sleeve is also provided with a flange 27. Extending towards the interior from the walls of the sleeve is a rod or protuberance 28 which interacts with the latch 23. Another protuberance or bar 29 also extends inwardly from the side walls of the sleeve.

Also provided in the described construction is a gasket 31 comprising a flexible and resilient piece of membranous material which is liquid and airtight. The gasket 31 in the assemblage of the parts of the protective closure of the present invention may be used if desired and when it is a part of the construction it is disposed on the ledge 16 provided interiorly of the inner ring 11.

The assembly and operation of the protective closure above described is as follows:

After the inner ring is formed the cap is placed thereon with the locks 18 and 19 accommodated in the slots 12 and 13. The front and side edges of the cap 17 rest upon the gasket 31 on the ledge 16. The sleeve 25 is then placed over the inner ring 11 with the rod 28 and bar 29 protruding into the notched portion 14. The sleeve 25 may be turned until the rod 28 engages the latch 23 and thus prevents further movement of the sleeve 25. In this position wherein the rod 28 engages latch 23 the pieces are locked together and provide a cap and closure which is sealed tight against liquid and air. A child's normal action in attempting to open the closure by turning the sleeve will not cause any disengagement of the parts. Instead to open the closure the front edge of the cap 17 is manually depressed causing the latch 23 to fall away from the rod 28. By manual manipulation the sleeve 25 is then turned to cause the rod 28 to assume a position away from the latch whereby the top will lift around the hinge 20 exposing the contents. There is limited movement in the turning of the sleeve 25 caused by the fact that the bar 29 will engage the sides of the notch when the sleeve 25 is turned in this direction. After the desired amount of the contents are dispersed through the opening, to relock the assembly it is merely necessary to depress the front edge of the cap. When this is done the bar 29 will automatically ride over the inclined plane 22 of the cam 21. This action causes the rod 28 to assume its position above the latch 23 and when the depressing force is released the latch 23 will re-engage the rod 28 to lock the cap in position.

If the cap is in an unlocked position the resilient membrane will cause it to lift whereby the unlocked condition is easily ascertainable by visual inspection.

Figure 8:
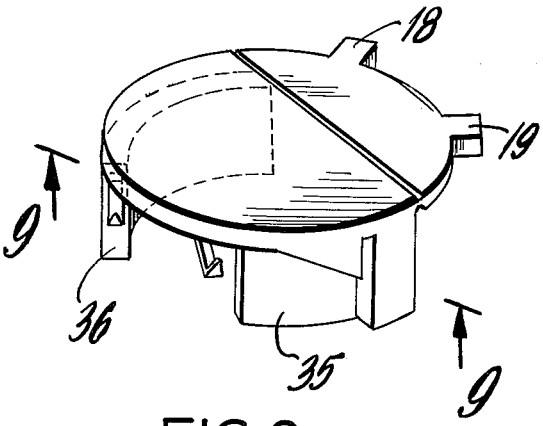
FIG. 8 is a perspective view of a modified form of cap for the closure.
Figure 9:
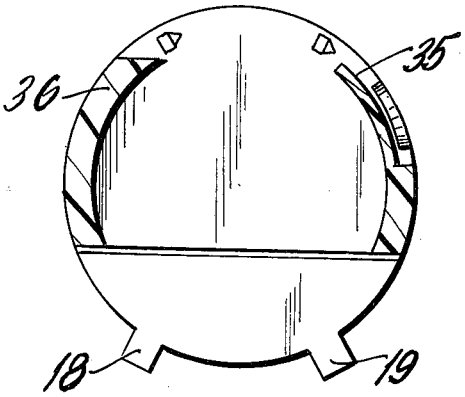
FIG. 9 is a sectional view taken along the lines 9—9 of FIG. 8.

As shown in FIGS. 8 and 9 the underside of the cap may be provided with shoulders 35 and 36 which fit into the recess of the opening of the container. When the cap is lifted the shoulders and the underside of the cap itself form a spout to facilitate the pouring and direct the flow of the contents.

The invention has been described in detail with reference to an illustrative embodiment thereof. However, the description and drawings are not to be construed as in any way limiting the scope of the invention as defined in the appended claims.

What is claimed is:

1. A safety closure for containers comprising:

a neck portion on a container, a liftable cap for the container, means comprising slots in said neck portion and cooperating lugs on the cap to interengage said neck portion and said cap, a sleeve surrounding said neck portion and said cap, and means to interlock the sleeve and the cap to prevent inadvertent opening of said cap.

2. A safety closure for containers comprising a neck portion on a container, a liftable cap for the container and means to interengage said neck portion and said cap, said neck portion being provided with a relatively elongated notch, a sleeve surrounding said neck portion and said cap having an inwardly extending rod on its inner side protruding into said notch on said neck portion of the container whereby the sleeve and the cap are interlocked to prevent inadvertent opening of said cap.

3. The invention as defined in claim 2 comprising, in addition, a latch on the underside of the cap adapted to engage the inwardly extending rod on the sleeve to lock the cap against inadvertent opening thereof.

4. The invention as defined in claim 3 comprising, in addition, an extended bar on the inner side of the sleeve adapted to ride in the notch in said neck of the container to limit movement of the sleeve.

5. The invention as defined in claim 4 comprising, in addition, a shoulder formed on the interior of the neck of the container, said cap being disposed on said shoulder.

6. The invention as defined in claim 5, comprising, in addition, a gasket disposed between said shoulder formed on the interior of the neck of the container and said cap.

* * * * *